US006839675B2

(12) United States Patent
Silfvast et al.

(10) Patent No.: US 6,839,675 B2
(45) Date of Patent: Jan. 4, 2005

(54) REAL-TIME MONITORING SYSTEM FOR CODEC-EFFECT SAMPLING DURING DIGITAL PROCESSING OF A SOUND SOURCE

(75) Inventors: Robert Denton Silfvast, Belmont, CA (US); Philip J. E. Campbell, Palo Alto, CA (US); Scott Silfvast, Palo Alto, CA (US); Andor Izsak, San Mateo, CA (US); Paul deBenedictis, Menlo Park, CA (US); Steven H. Milne, Palo Alto, CA (US)

(73) Assignee: Euphonix, Inc., Palo Alto, CA (US)

( * ) Notice: Subject to any disclaimer, the term of this patent is extended or adjusted under 35 U.S.C. 154(b) by 589 days.

(21) Appl. No.: 09/795,948

(22) Filed: Feb. 27, 2001

(65) Prior Publication Data

US 2002/0120458 A1 Aug. 29, 2002

(51) Int. Cl.[7] ..... G10L 19/00

(52) U.S. Cl. ..... 704/500; 704/501; 84/662

(58) Field of Search ..... 704/223, 262, 704/214, 503; 348/39, 467, 505, 500, 521; 345/531, 541; 714/752, 818; 710/74; 84/50

(56) References Cited

U.S. PATENT DOCUMENTS 5,652,797 A * 7/1997 Okamura et al. ..... 381/61
5,859,826 A * 1/1999 Ueno et al. ..... 369/47.2
6,640,257 B1 * 10/2003 MacFarlane ..... 710/1

* cited by examiner

*Primary Examiner*—Susan McFadden
*Assistant Examiner*—Huyen X. Vo
(74) *Attorney, Agent, or Firm*—Donald R. Boys

(57) ABSTRACT

A digital processing system for monitoring sound effects produced by codecs during a signal processing session is provided. The digital processing system comprises, a sound source for producing signals for processing, a sound monitor having at least two channels for monitoring sound quality of the sound source, a sound recorder for recording the sound source, a playback device for playing a recorded file of sound produced by the sound source, a codec simulator for simulating sound effects produced by codecs, a plurality of codecs for compressing and decompressing sound files and a control interface for sampling, adjusting, and implementing an optimum codec based on monitoring of sound effects produced by codec simulation. A user controlling the system may monitor sound variances produced by any one of the plurality of codecs affecting the quality of sound from the sound source during signal processing of the source sound without interruption of the signal-processing session.

18 Claims, 6 Drawing Sheets

REAL-TIME MONITORING SYSTEM FOR CODEC-EFFECT SAMPLING DURING DIGITAL PROCESSING OF A SOUND SOURCE

FIELD OF THE INVENTION

The present invention is in the field of digital signal processing and pertains more particularly to methods and apparatus for real-time user monitoring.

BACKGROUND OF THE INVENTION

The technology pertaining to sound recording and reproduction originated late in the 19th century with several key inventions beginning with simple energy transforming devices and later including such devices as simple photographs, and development of the vacuum tube enabling electrical impulse amplification. Recent technology has incorporated the use of magnetic tape, digital data recording, and advanced digital signal processing. Such modern digital processing and recording techniques have more recently been integrated into a large segment of the music recording industry, enabling those skilled in the art, such as sound engineers or technicians using digital signal processing, to shape the final sound qualities of a signal source such as a musical instrument for example. Modern digital recording techniques typically also include the use of multiple signal sources and signal mixing consoles allowing the user to establish loudness levels of each signal in relationship to one another.

During the process of digital recording data is often compacted, reducing the data density to allow for more efficient transmission or storage, using a process known in the art as compression. Once the compressed data has been processed it must first be decompressed before the resulting sound can be heard. Data compression and decompression is achieved by applying certain algorithms which can be implemented in software applications or by a dedicated computer chip, or plurality thereof, known as a compressor/decompressor, commonly referred to in the art by its acronym: codec.

It is assumed by many users in the art that resulting sound, after compression and decompression, is generally not greatly affected by the process. However, depending on the type of signal source and compression/decompression techniques utilized, some adverse affects on data can occur during the process, sometimes causing modifications to the resulting sound. To ensure data integrity, every compression algorithm must have a matching decompression algorithm, and because compression reduces data density as previously described, a problem is presented in that the resulting sound is almost always invariably affected to some degree. Moreover, the degree to which the process of compression and decompression affects the resulting sound is a subjective judgment of the human ear. For example, a compression/decompression algorithm that creates only a small change to the resulting sound in terms of percent of total harmonic distortion, for instance, may cause the created sound, in its final form, to have undesirable audible characteristics when played back. In contrast, another algorithm having a high change percentage of total harmonic distortion may result in desirable audible effects resulting from, to a degree greater than that of the change to the data itself, the effects on the final sound.

To determine the effect of compression and decompression on a digital sound recording, a user in the current art must first make the recording and listen to the playback, making any changes as necessary including changing the mode of the codec, for example. By doing so, a user can judge what degree of effect the compression/decompression algorithm set currently in use has on the sound quality of the recording. A problem is presented by this method however, since during the recording process, a user wishing to listen to the digital recording must first stop recording and then go into a playback mode at which point the compression algorithm being used during recording is replaced with a decompression algorithm, thus allowing playback of recording. Such a method can require multiple, sometimes inconvenient and disruptive steps resulting in a cumbersome overall process for many users.

What is clearly needed is a method allowing a user, during the process of making a digital recording, to simultaneously monitor the sound being recorded, perceiving it as it would sound in its final form after compression and decompression. By utilizing such an improved method a user can eliminate many cumbersome steps in determining compression/decompression effects, thus making more efficient use of recording time and resources. Such a method is described in enabling detail below.

SUMMARY OF THE INVENTION

In a preferred embodiment of the present invention, a digital processing system for monitoring sound effects produced by codecs during a signal processing session is provided. The digital processing system comprises a sound source for producing signals for processing, a sound monitor having at least two channels for monitoring sound quality of the sound source, a sound recorder for recording the sound source, a playback device for playing a recorded file of sound produced by the sound source, a codec simulator for simulating sound effects produced by codecs, a plurality of codecs for compressing and decompressing sound files and a control interface for sampling, adjusting, and implementing an optimum codec based on monitoring of sound effects produced by codec simulation.

A user controlling the system may monitor sound variances produced by any one of the plurality of codecs affecting the quality of sound from the sound source during signal processing of the source sound without interruption of the signal-processing session.

In one aspect, the sound source may comprise multiple sound inputs that are mixed and filtered before monitoring. Also in one aspect, the sound source is produced during a live studio session. In another aspect, the sound source is produced by playback of a previously recorded sound file. In a preferred aspect regardless of the nature of the sound source, one channel of the sound monitor enables monitoring of sound quality before application of codec effects and a subsequent channel of the sound monitor enables monitoring of sound quality after application of codec effects. In one embodiment, the codec effects are simulated. In another embodiment, the codec effects are real. In still another embodiment, the simulated codec effects are of the form of plug-in modules that may be inserted into plug-in bays of the system. In all applications, the control-interface is a software application displayable on a video-display unit. In one aspect, the video-display unit is PC enabled.

In a digital processing system, a method for monitoring sound effects produced by codec effects during a signal processing session concurring on the system and selecting a proper codec for the session is provided. The method comprises the steps of, (a) inputting a sound source for processing into the system, (b) mixing and filtering the sound input from the sound source for optimum digital quality, (c) monitoring the sound quality produced by the mixing and filtering, (d) selecting and applying codec effects to the mixed and filtered sound, (e) monitoring the sound quality produced by selection and application of codec effects to the mixed and filtered sound and (f) selecting and applying the optimum codec for the concurring session based on monitoring results.

In one aspect of the method in step (a), the sound source is a live source. In another aspect, in step (a), the sound source is a prerecorded source. In a preferred application of the method steps (c) and (e) are practiced alternately using a selectable channels of a sound-monitoring headset. In one aspect of the method in step (d), the codec effects are produced by simulation. In another aspect, in step (d), the codec effects are real. In still another aspect of the method in step (d), the simulated codec effects are applied by using a plug-in module. And in still another application, in step (f), the actual codec selected is obtained from a digital library of codecs accessible to the system through user control.

Now, for the first time, a method allowing a user, during the process of making a digital recording, to simultaneously monitor the sound being recorded, perceiving it as it would sound in its final form after compression and decompression is provided. By utilizing such an improved method a user can eliminate many cumbersome steps in determining compression/decompression effects, thus making more efficient use of recording time and resources.

BRIEF DESCRIPTION OF THE DRAWING FIGURES

DESCRIPTION OF THE PREFERRED EMBODIMENTS

As previously described, a typical digital recording and mixing system consists of many separate functional units including an apparatus for changing signal strength and characteristics, signals incoming from usually more than one signal or sound source, a digital recording apparatus for processing and saving of digital signals, and an apparatus enabling playback of the digital recording.

Figure 1:
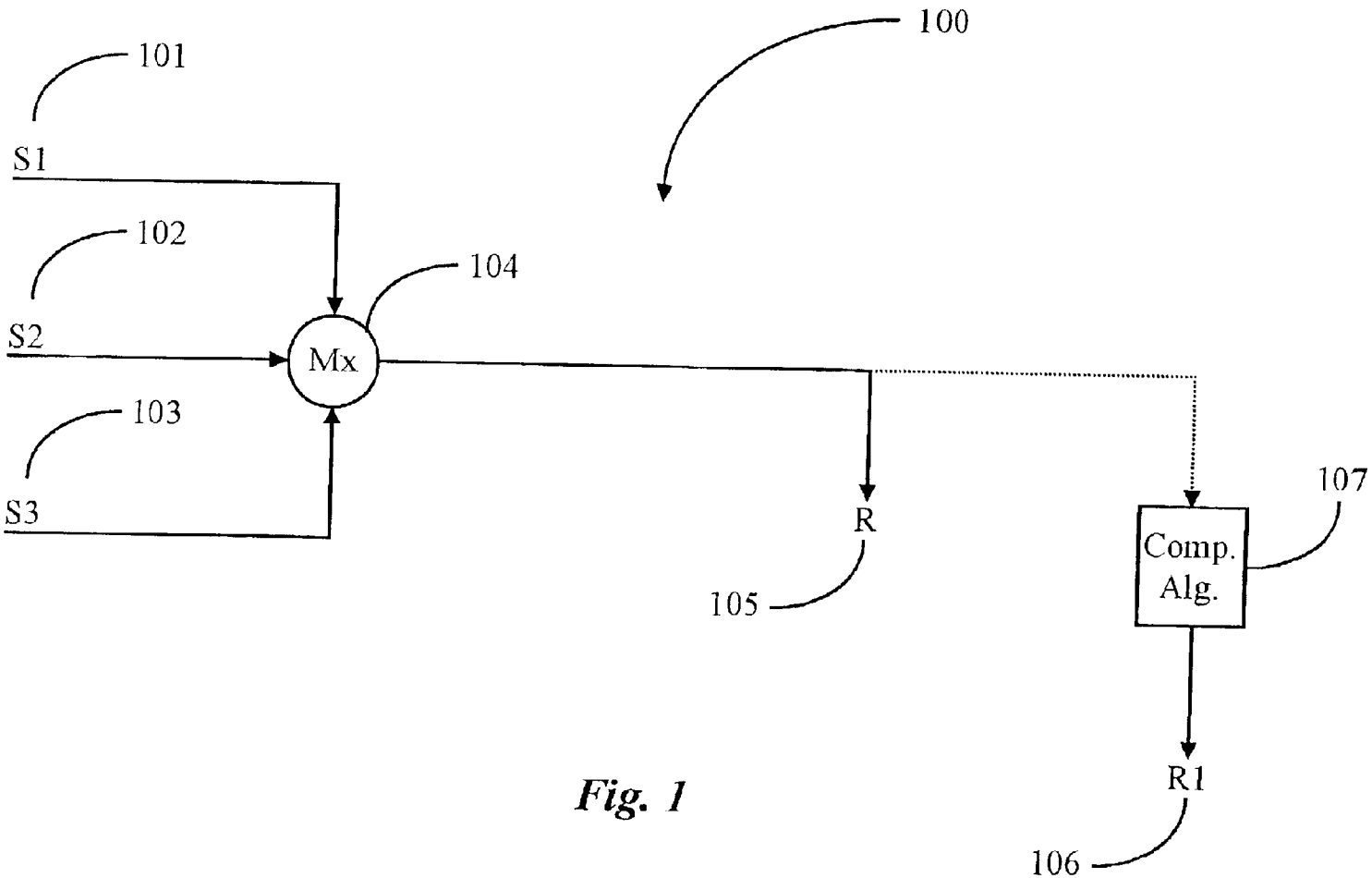
FIG. 1 is a simplified block diagram of a typical recording and mixing system according to conventional art.

FIG. 1 is a simplified block diagram of a typical recording and mixing system according to conventional art. For reasons of clarity and simplicity, elements of FIG. 1 are represented only by simple block characters without details of their specific operations. System 100 is shown in this example having a plurality of sound or signal inputs, typical of mixing and recording systems known in the art, represented as source S1 101, source S2 102, and source S3 103. Signal sources such as described in a typical system are mixed in a signal mixing console such as mixer Mx 104 allowing the user to establish loudness levels and possibly other characteristics for each signal in relationship to other signals. Processed digital signals can then be directed from mixer Mx 104 to a digital recording device such as recorder R 105, or can be alternatively compressed utilizing an algorithm such as compression algorithm 107, for example, and subsequently recorded by a device such as recording device R1 106. It is assumed the resulting digital recording can then be heard using a playback device that when actuated, invokes a decompression algorithm to expand the compressed data before the data is rendered as audio. For reasons of simplicity and clarity however, a playback device and decompression algorithm are not shown in this view.

A system known in current art such as described above can have many more different components then are depicted in FIG. 1, such as the number of signal sources, recording devices and so on, and the example is presented only as a base for novel improvements, according to the present invention, shown later in enabling detail. As previously mentioned, a user utilizing current technology to monitor the effect of compression and decompression on a digital sound recording, must first stop the recording process and then playback and listen to the recording in order to make a final determination. Such a process is commonly performed in a typical digital recording and mixing system or studio such as described above. It is the object of the present invention to provide new and novel methods and apparatus, greatly increasing the monitoring capabilities of an average user.

Figure 2:
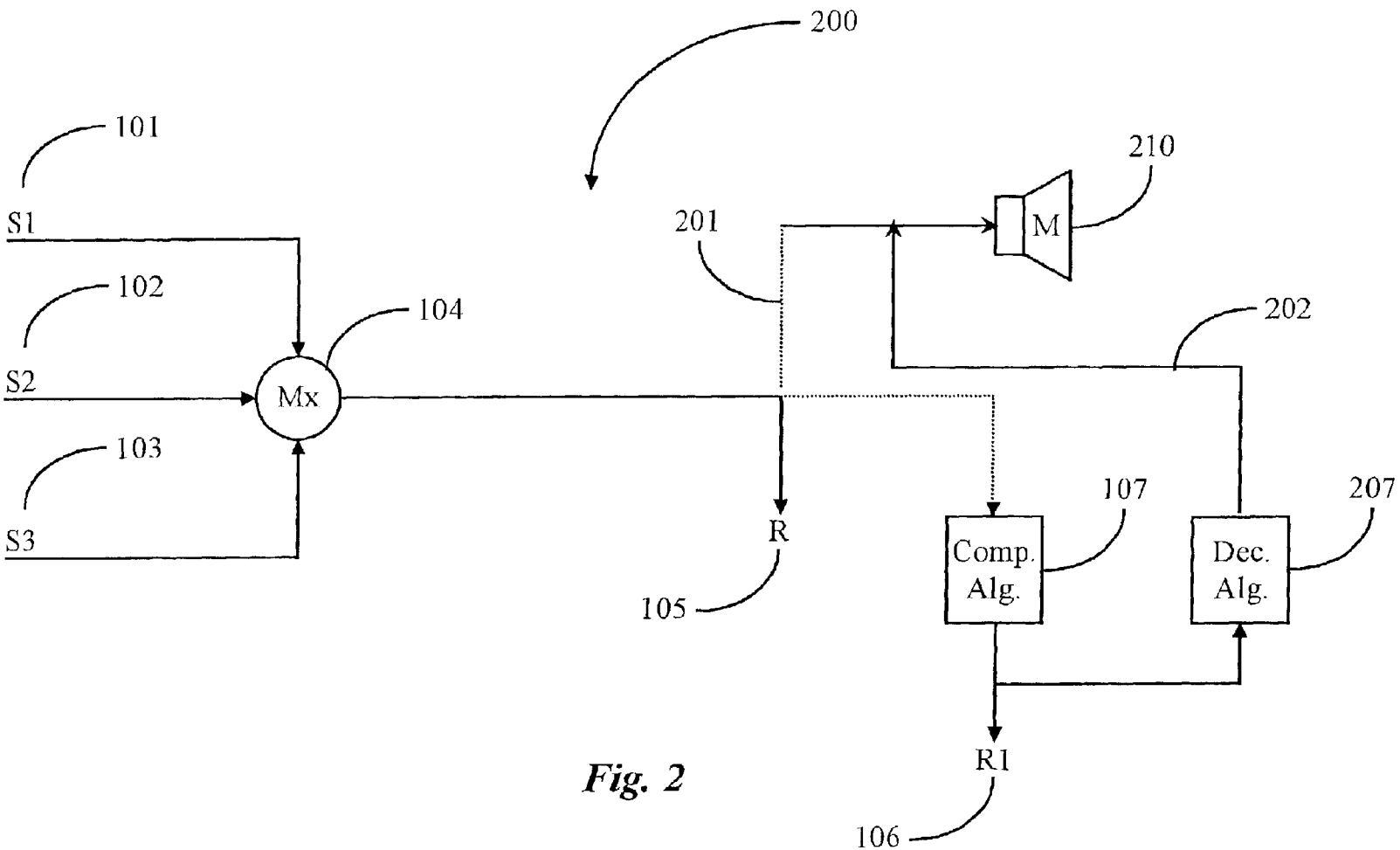
FIG. 2 is a simplified block diagram of a recording and monitoring system according to embodiment of the present invention.

FIG. 2 is a simplified block diagram of a recording and monitoring system according to embodiment of the present invention. System 200 is provided having signal inputs S1 101, S2 102 and S3 103, and a mixer Mx 104 identical to those of system 100 of FIG. 1. Such mixing and preprocessing is, however, not required for the present invention, but will often occur in the same system. A recorder R 105, compression algorithm 107 and recorder R1 106 are depicted as well, also having identical functions to those of system 100 of FIG. 1. Sound monitor 210 is provided in this embodiment enabling a user to listen to a digital recording during playback and is incorporated, along with other novel elements as will be described, to provide the average user with an improved monitoring process. The present invention enables a user to perform real-time monitoring of a digital recording during playback, in order in this example, to determine the degree of effect the process of compression/decompression has on the recording Using a monitoring process such as described in this embodiment can either monitor a sound source prior to compression, using a connection line 201 connecting monitor 210 to the uncompressed sound source from mixer Mx 104, or monitor in real-time a sound source during decompression using a connection line 202 connecting monitor 210 to a decompression algorithm 207. The recorded compressed signal R1 106, directed from compression algorithm 107 contained in software or a codec for example, is decompressed in real-time by decompression algorithm 207.

The above described method allows the user, hearing signal delays ranging from between several milliseconds to a few seconds in some cases, to hear the effect that the currently-used compression/decompression system has on the sound quality. The resulting improved monitoring process provides effects comparable to systems known in current art utilizing a separate monitor head used in conjunction with a second recording head as found on some older or high-end types of common tape recorders, while having all of the known advantages provided by digital technology. As is true for system 100 of FIG. 1, the elements of system 200 are greatly simplified, and are presented in only as an overview of an improved system according to an embodiment of the present invention. As such, only essential elements of the embodiment are depicted, and many other possible details, present or not, in a complete recording and playback system, are not shown in FIG. 2. Similarly, it is clear and should be assumed that connections such as connection lines 201 and 202 may require signal conversion from analog to digital for example, or vice versa, depending on equipment used. These and other details such as filters that might be applied in the mixing process, or signal amplifiers, etc., are also omitted for reasons of clarity. Also, in some cases, multiple different algorithms can be exchanged one against another, as to compare the results between different compression/decompression algorithms. A simple selector (not shown) can be used to choose between different algorithms.

In alternative preferred embodiments of the present invention the compression/decompression algorithms may be implemented in many different ways. In other alternative preferred embodiments an improved monitoring process, as described in FIG. 2, allowing a user to determine compression/decompression effects in real-time, may be applied utilizing input signals from a live recording, bypassing the mixing and/or recording processes. In still other alternative embodiments a real-time monitoring process such as described may be implemented on signal files that have been previously mixed outside of the current system in order to determine the format allowing the best possible electronic distribution of the file. For example, a mastering engineer may wish to convert a stereo sound file commonly known as a .WAV file, into a different digital format such as another compressed sound file known as .MP3, for distribution and use by a specific media player designed only to handle that particular format.

Utilizing new and novel processes described herein, the engineer is able to playback the digital recording in .WAV format utilizing a software player such as is known to the inventor, and to simultaneously monitor the file utilizing a codec designed for the MP3 format. The engineer can now make any adjustments necessary, such as parametric equalization and so on, to the file while running on the previously mentioned software player, thereby minimizing unwanted effects of compression and decompression.

In still other alternative embodiments of the present invention, in addition to changes made to a digital recording at the mixing console or in post-processing utilizing a previously mentioned software player, an engineer may also control the sound quality of the digital recording by adjusting parameters within the codec(s) themselves, or may choose from many different sets of possibly a multitude of codecs available.

Figure 3:
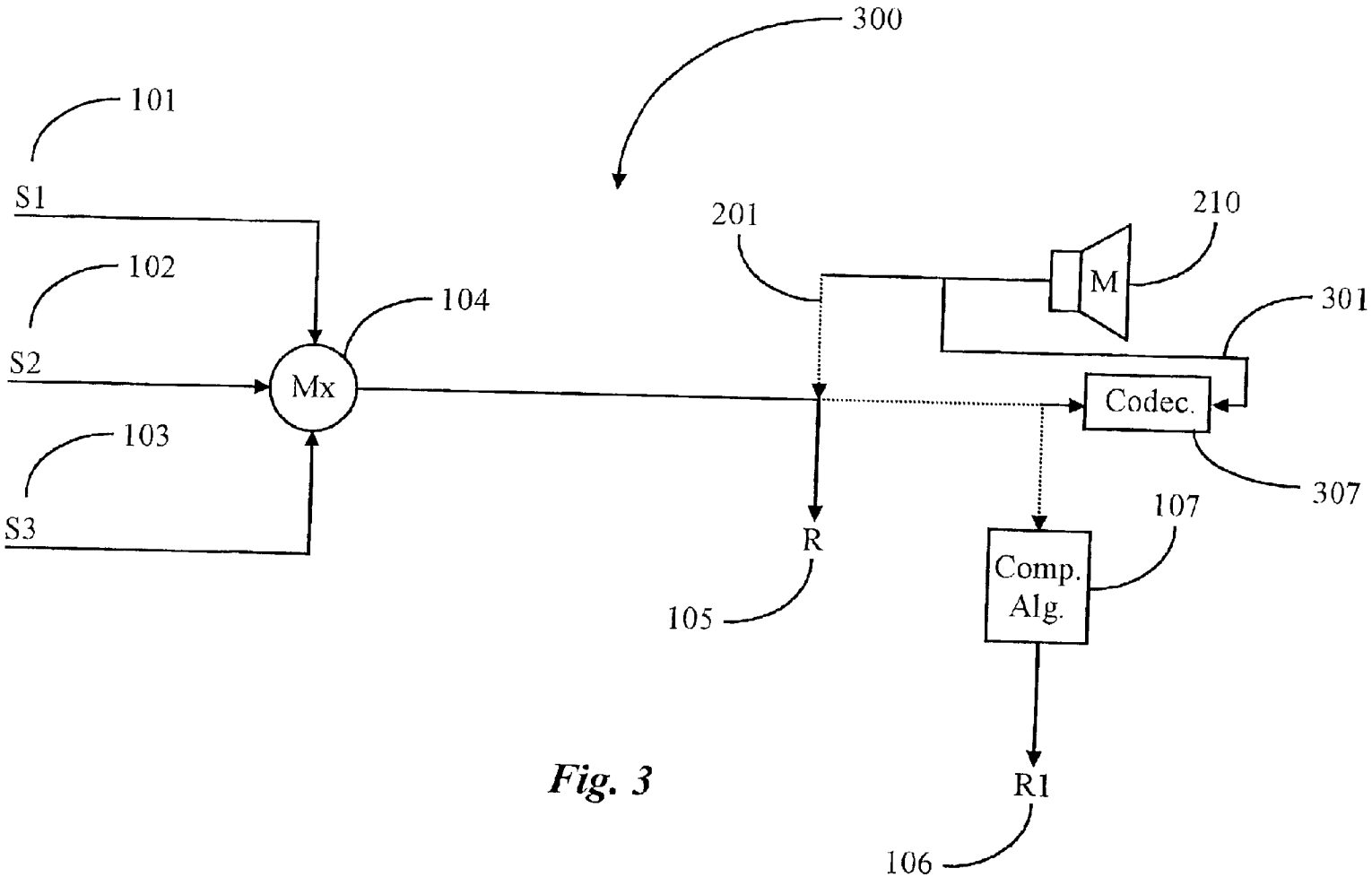
FIG. 3 is a simplified block diagram of a recording and monitoring system according to another embodiment of the present invention.

FIG. 3 is a simplified block diagram of a recording and monitoring system according to another embodiment of the present invention providing a further enhancement to embodiments previously described. System 300 is provided having signal inputs S1 101, S2 102 and S3 103, and a mixer Mx 104 identical to those of system 200 of FIG. 2. A recorder R 105, sound monitor 210, compression algorithm 107, recorder R1 106 and connection line 201 are depicted as well, also having identical functions to those of system 200 FIG. 2. Codec 307, while running parallel to compression algorithm 107, is provided in this embodiment to simulate, in one step, the effect that compression and decompression would have on a sound file. Utilizing monitor 210 similarly to previously described methods, a user has the ability to monitor the output of simulation codec 307, nearly in real-time, during playback of the digital file. Thus, in some cases system 300 may still perform full compression and decompression of the digital file, while in other cases system 300 may simply filter the sound producing the same effect as if running the sound through a full compression and decompression cycle, without actually performing the compression and decompression process. Utilizing such a system greatly minimizes the latency of processes currently known in the art and maximizes monitoring effectiveness and efficiency by providing near real-time monitoring of a compressed and decompressed input signal. As previously mentioned the output of codec 307 in this embodiment can be heard from sound monitor 210 via line 301, or alternatively, sound monitor 210 can be connected via line 201 to the sound source directed from mixer Mx 104 for comparison. As in embodiments previously described, systems according to other alternative embodiments of the invention as described herein may contain many other details not essential to present embodiments described, such as number of signal sources, type of connection lines and so on, can vary greatly and may or may not be present, and some functions described can be executed by either hardware or software.

Figure 4:
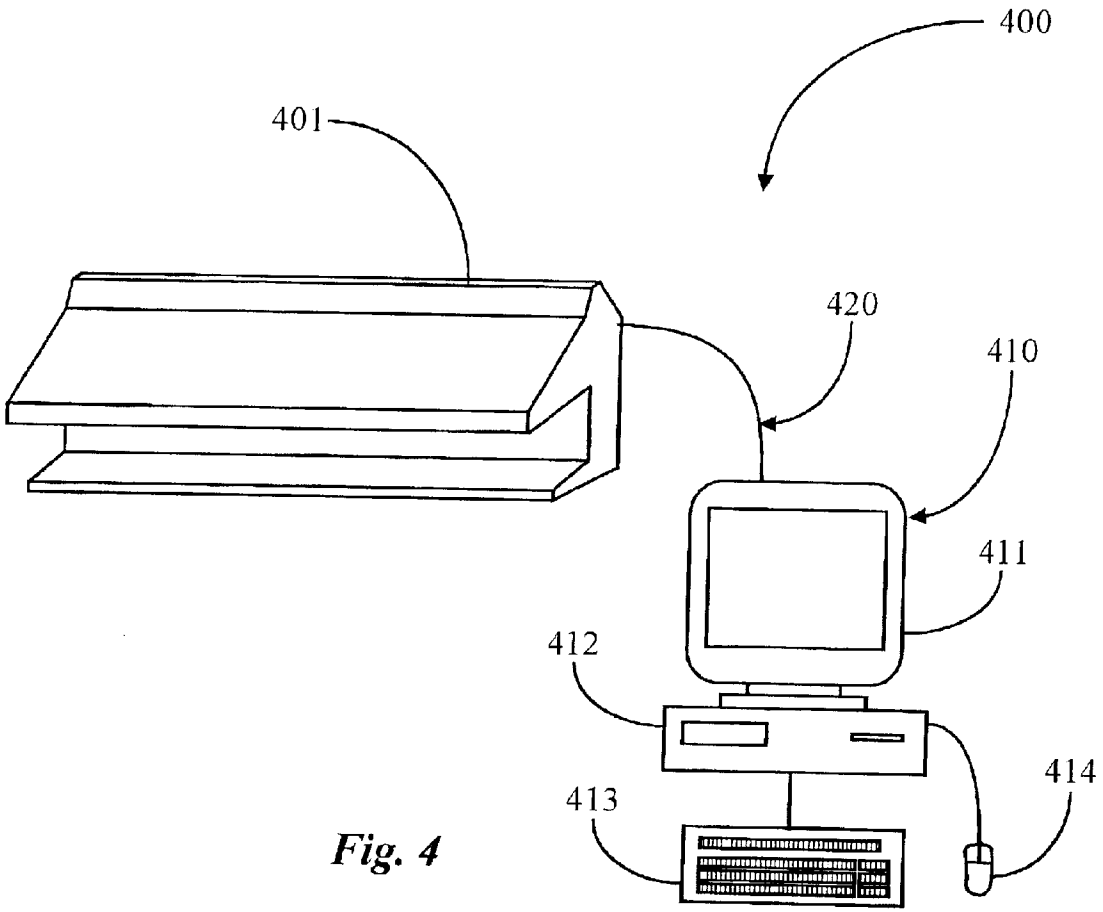
FIG. 4 is a simplified diagram of a typical recording system according to conventional art.

As described earlier, a conventional digital mixing/recording system consists of several functional units including, but not limited to, a mixing console, a recording and playback apparatus, and so on. Many such components require commands and controlling functions to be executed by a user using the components' own separate command interface which can either be hardware or software in nature, or a combination thereof. FIG. 4 is a simplified diagram of such a typical recording system according to conventional art. System 400 includes, but is not limited to, a mixing system 401, connected via line 420 to a computer system 410 which may include, but is not limited to, a display monitor 411, a main unit 412, a keyboard 413, and a pointing device 414. Line 420 is a typical connection utilizing various interfaces having properties of high bandwidth and control command capability such as a multichannel audio digital interface, commonly referred to in the art as MADI, or other similar interfaces having like capability. For reasons of simplicity some elements of a typical recording system such as described, and many details of present components are not shown but should be assumed to be present, elements such as signal inputs sources and signal processing software that may be contained within computer system 410, and so on. It is the purpose of FIG. 4 to present a simplified view of a typical system as a pretense to novel improvements later described.

Figure 5:
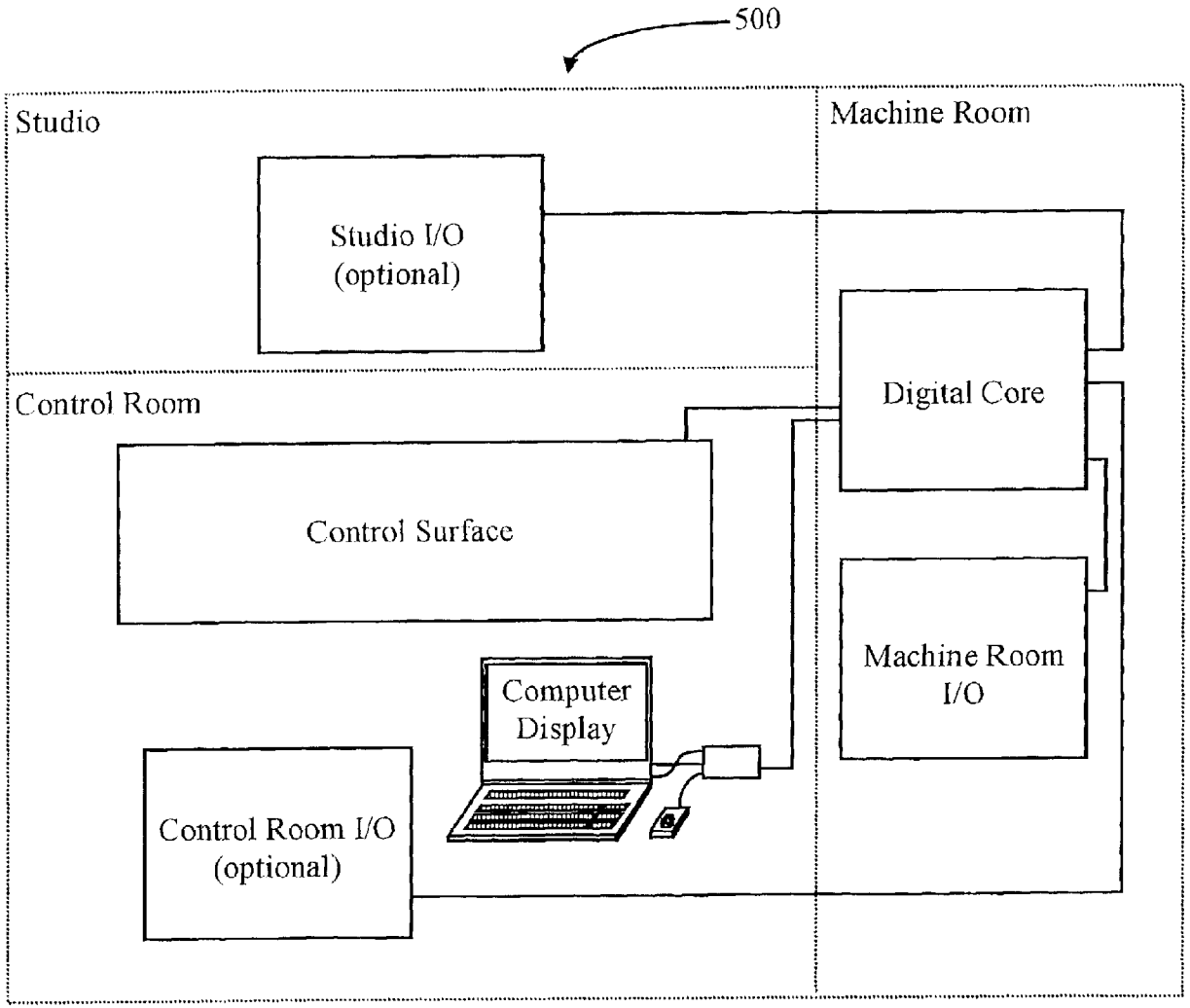
FIG. 5 is a simplified block diagram of equipment layout for a typical recording studio.

Some digital mixing and recording systems existing in current art allow storage and loading of configurations as an auxiliary control for a mixer. However, as is true for other conventional systems, a plurality of command interfaces still exist creating the control problems for a user similar to problems previously described. FIG. 5 is a simplified block diagram of equipment layout for such a digital mixing and recording studio. Studio 500 is shown to have separate interconnected functional units contained in separate functional areas labeled Studio, Control Room, and Machine Room. As is true for FIG. 4, FIG. 5 is presented only as a representation of a system according to current art, and as a basis for novel improvements.

Figure 6:
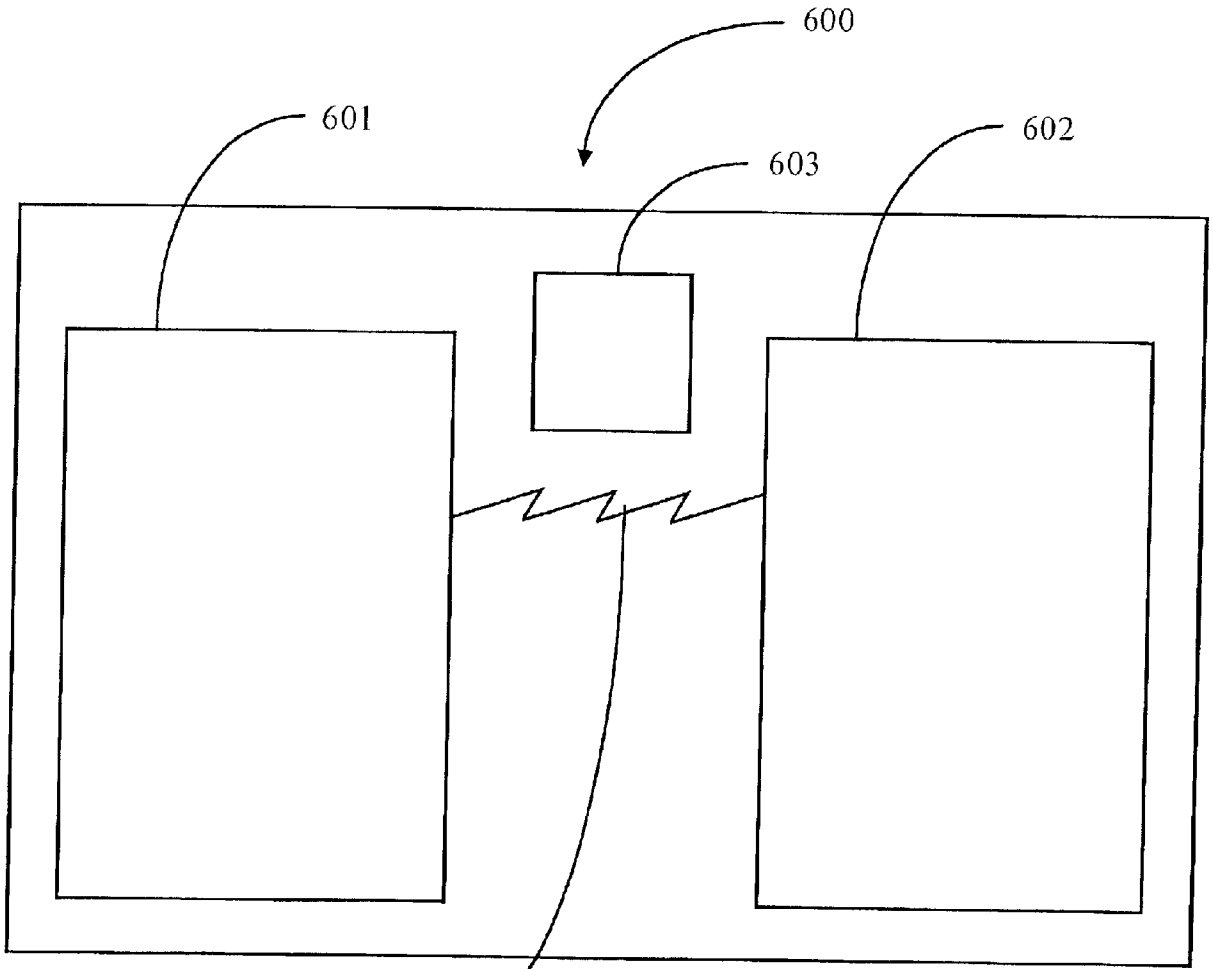
FIG. 6 is a simplified block diagram of a mixing and recording integration system according to an embodiment of the present invention.

FIG. 6 is a simplified block diagram of a mixing and recording integration system according to an embodiment of the present invention. An example of a command interface integration system is presented in this simplified view, as an embodiment of the present invention eliminating the problems presented in a system of conventional art that utilizes multiple command interfaces. Screen layout 600 is provided as a simplified command interface integration system having a sectional window 601 containing the command interface pertaining to the mixing function, sectional window 602 with a command interface pertaining to the recording function, and a sectional window 603 with a command interface pertaining to system management, for the purpose of, for example, storing and loading configurations pertaining to both recording and mixing functions. A symbolic link between the command interfaces of windows 601 and 602 is represented as element 604, and may represent in various embodiments such actions as sound signals directed from mixing window 601 to recording window 602, and could possibly provide a graphical representation of said activity. By utilizing such a method combining command interfaces for separate functional areas into one interface area, a user gains much effectiveness in controlling the different functions and utilizes the available studio time much more efficiently.

It will be apparent that the embodiment described in FIG. 6, as well as other embodiments previously described, is only one example of many possible implementations of the current invention and limitless variations of embodiments of the novel art described herein can exist. Such embodiments provide the user with a simple and thorough integration of separate command interfaces, allowing changes made in one interface area that effect another functional area, such as a mixing pattern in the mixing interface window that effects a recording pattern for instance, to be easily and automatically integrated. Additionally, settings that are configured in multiple command interfaces utilizing a novel and new integration process such as described, can be easily stored for future retrieval in one set up action performed by the user utilizing the management functions as described in interface window 603. For example, certain selected files, stored in certain groupings, may be retrieved and re-loaded at every recording session, along with a preferred pre-configured set up of different instruments on mixing panel, thus allowing a much shorter set up and preparation time before the recording session can begin. Such faster preparation and set up saves the user valuable studio time, reducing cost and effort, particularly useful to users paying time-based studio rental fees on the space and equipment, for those users wishing to record live musicians compensated on an hourly basis. The simple diagrams presented herein are sufficient to describe the system and practice of the present invention and for these reasons must be accorded the breadth of the claims, which follow:

What is claimed is:

1. A digital processing system for monitoring sonic artifacts produced by codecs during a signal processing session comprising:

a sound source for producing signals for processing;

a sound monitor having at least two channels for monitoring sound quality of the sound source;

a sound recorder for recording the sound source;

a playback device for playing a recorded file of sound produced by the sound source;

a codec simulator for simulating sonic artifacts produced by codecs;

a plurality of codecs for compressing and decompressing sound files; and, a control interface for sampling, adjusting, and implementing an optimum codec based on monitoring of sonic artifacts produced by codec simulation, characterized in that a user controlling the system may monitor sound variances produced by any one of the plurality of codecs affecting the quality of sound from the sound source during signal processing of the source sound without interruption of the signal-processing session.

2. The digital processing system of claim 1, wherein the sound source comprises multiple sound inputs that are mixed and filtered before monitoring.

3. The digital processing system of claim 2, wherein the sound source is produced during a live studio session.

4. The digital processing system of claim 2, wherein the sound source is produced by playback of a previously recorded sound file.

5. The digital processing system of claim 2, wherein one channel of the sound monitor enables monitoring of sound quality before application of codec effects and a subsequent channel of the sound monitor enables monitoring of sound quality after application of codec effects.

6. The digital processing system of claim 5, wherein the codec effects are real.

7. The digital processing system of claim 5, wherein the codec effects are simulated.

8. The digital processing system of claim 7, wherein the simulated codec effects are of the form of plug-in modules that may be inserted into plug-in bays of the system.

9. The digital processing system of claim 7, wherein the control-interface is a software application displayable on a video-display unit.

10. The digital processing system of claim 9, wherein the video-display unit is PC enabled.

11. In a digital processing system, a method for monitoring sonic artifacts produced by codec effects during a signal processing session concurring on the system and selecting a proper codec for the session comprising the steps of;

(a) inputting a sound source for processing into the system;

(b) mixing and filtering the sound input from the sound source for optimum digital quality;

(c) monitoring the sound quality produced by the mixing and filtering;

(d) selecting and applying codec effects to the mixed and filtered sound;

(e) monitoring the sound quality produced by selection and application of codec effects to the mixed and filtered sound; and (f) selecting and applying the optimum codec for the concurring session based on monitoring results.

12. The method of claim the 11 wherein in step (a), the sound source is a live source.

13. The method of claim 11 wherein in step (a), the sound source is a prerecorded source.

14. The method of claim 11, wherein steps (c) and (e) are practiced alternately using a selectable channels of a sound-monitoring headset.

15. The method of claim 14 wherein in step (d), the codec effects are produced by simulation.

16. The method of claim 14 wherein in step (d), the codec effects are real.

17. The method of claim 14 wherein in step (f), the actual codec selected is obtained from a digital library of codecs accessible to the system through user control.

18. The method of claim 17 wherein in step (d), the simulated codec effects are applied by using a plug-in module.

* * * * *